United States Patent [19]

Gegere

[11] Patent Number: 4,807,585

[45] Date of Patent: Feb. 28, 1989

[54] RUBBER BAND POWERED GUN

[75] Inventor: Michael A. Gegere, 1020 Bartlett Dr., Vista, Calif. 92084

[73] Assignees: John O. Beckwith, Encinitas; Michael A. Gegere, Vista, both of Calif.

[21] Appl. No.: 14,940

[22] Filed: Feb. 17, 1987

[51] Int. Cl.[4] ..... F41B 7/08

[52] U.S. Cl. ..... 124/21; 124/17

[58] Field of Search ..... 124/16, 17, 21, 22

[56] References Cited

U.S. PATENT DOCUMENTS

| | | | |
|---|---|---|---|
| 253,628 | 2/1882 | Rich | 124/21 |
| 285,368 | 9/1883 | Trieller | 124/21 |
| 355,975 | 1/1887 | Crandall | 124/21 |
| 1,209,974 | 12/1916 | Kerwin | 124/16 X |
| 1,484,930 | 2/1924 | Bunten | 124/21 |
| 1,568,999 | 1/1926 | Bunten | 124/21 |
| 3,963,017 | 6/1976 | Pfotenhauer | 124/21 |

FOREIGN PATENT DOCUMENTS

| | | | |
|---|---|---|---|
| 939922 | 11/1948 | France | 124/21 |

*Primary Examiner*—Randolph A. Reese
*Assistant Examiner*—John A. Ricci
*Attorney, Agent, or Firm*—Brown, Martin, Haller & Meador

[57] ABSTRACT

A rubber band powered gun includes a barrel assembly within which a projectile traveller slides between a cocked position and a release position. A singulator also slides in the barrel assembly and feeds a single projectile from a magazine to the traveller each time the traveller moves from the release to the cocked position. A slide, movably mounted on the barrel assembly, engages and moves the traveller to the cocked position. At the cocked position, the slide disengages the traveller and is movable toward the release position. A rubber band is connected between the traveller and the slide for exerting an elastic force directed toward the release position on the traveller at the cocked position in response to movement of the slide toward the release position. A trigger is provided for retaining the traveller at the cocked position while the slide moves toward the release position. A mechanism retains the slide at the release position. The trigger releases the traveller from the cocked position and the traveller is accelerated by the rubber band toward the release position. A projectile deposited in the traveller by the singulator is projected on an exit trajectory out of the barrel when the traveller is stopped at the release position.

11 Claims, 3 Drawing Sheets

RUBBER BAND POWERED GUN

BACKGROUND OF THE INVENTION

The invention is in the field of toy guns and concerns toy guns which use rubber bands to fire projectiles.

Zip guns are known which use a rubber band mounted on a gun housing to carry a firing pin against a loaded cartridge. The rubber band is stretched away from the firing rim of the cartridge so that the firing pin is placed under an elastic tension directed toward the cartridge firing rim. The cartridge is held in position in a barrel mounted on the gun housing such that the firing rim of the cartridge faces the cocked firing pin, while the projectile in the cartridge is directed through the barrel toward the muzzle of the gun. When the rubber band is released, the firing pin is accelerated by the collapsing rubber band against the firing rim of the cartridge. The cartridge is activated when the firing pin strikes the primer in the firing rim; the cartridge charge explodes and the expanding gases generated by the explosion accelerate the cartridge projectile through the barrel toward the muzzle.

Toy guns which shoot projectiles such as pellets, B-B's, or round shot characteristically use pneumatic means to pump a charge of compressed air which is released by a trigger and directed through a pneumatic tube against a single shot held in the barrel of the air gun. The expansion of the compressed air against the shot accelerates it out of the barrel toward the muzzle. As is known, the pneumatic mechanisms of air guns and other compressed gas-powered weapons are subject to corrosion and leakage, both of which cause the gun to eventually lose its firepower. Replacement of the pneumatic mechanism is impractical and expensive. Therefore, when a pneumatic gun loses its potency, the gun usually is discarded and a new one obtained.

Typically, the non-pneumatic moving parts of an air gun outlast the pneumatic parts of the gun's firing mechanism. Therefore, there is a clear,,need to provide a non-pneumatic firing mechanism which both wears as long as the other non-pneumatic parts of a pellet gun and which can be easily and inexpensively replaced when worn.

SUMMARY OF THE INVENTION

The invention is founded on the critical observation made by the inventor that the rubber band of the Zip gun is easily and inexpensively replaceable and therefore satisfies the long-felt need in the toy gun field for a projectile firing mechanism which is easily discarded and replaced when worn.

The invention resides in a rubber band powered toy gun having a barrel assembly with a magazine for holding shots. A shot singulator is slidably held in the barrel assembly and is movable in the barrel assembly between a first position in communication with the magazine and a second position out of communication with the magazine. An aperture in the shot singulator accepts a single shot from the magazine at the first position. A traveller mechanism, also slidably held in the barrel assembly, is movable in the barrel assembly between a release position and a cocked position. The traveller mechanism includes means for engaging the shot singulator and moving the shot singulator from the first to the second position when the traveller mechanism moves from the release to the cocked position. Means are provided in the traveller mechanism for receiving a shot from the singulator and for retaining a received projectile while the traveller mechanism moves from the cocked position to the release position. An elastic rubber band is attached to the traveller mechanism for accelerating it from the cocked to the release position. A cocking slide, slidable on the barrel assembly, moves the traveller mechanism from the release to the cocked position, at the same time stretching the rubber band and subjecting the traveller mechanism to an elastic force directed toward the release position.

Alternatively, the invention is a rubber band powered pistol including a barrel assembly with a shot magazine and a shot traveller slidably held in the barrel assembly for receiving a shot, for moving a shot to a cocked position in the barrel assembly, and for moving a shot into a firing trajectory extending through the barrel assembly by accelerating from the cocked position to a release position. The pistol includes a singulator in the barrel assembly for feeding a single shot from the magazine to the shot traveller when the shot traveller moves from the release to the cocked position. A slide, movable on the barrel assembly, engages and moves the shot traveller to the cocked position and disengages the traveller at the cocked position and moves toward the release position. A rubber band is connected between the shot traveller and the slide and exerts an elastic force toward the release position on the shot traveller at the cocked position in response to movement of the slide toward the release position. Finally, a trigger retains the shot traveller at and releases the shot traveller from the cocked position.

An objective of this invention is to provide a shot firing mechanism for a toy gun, which is powered by a rubber band.

A further objective of this invention is to utilize a replaceable rubber band to accelerate a shot through and out of a toy pistol.

These and other objects and other attendant advantages of the invention will become evident upon reading the detailed description in connection with the below-described drawings, in which:

FIG. 1 a side elevation view of a typical toy pistol incorporating the rubber band firing mechanism of the invention;

FIG. 2 is an enlarged sectional view taken along line 2—2 of FIG. 1;

FIG. 3 an enlarged sectional view taken along line 3—3 of FIG. 1;

Figure 1:
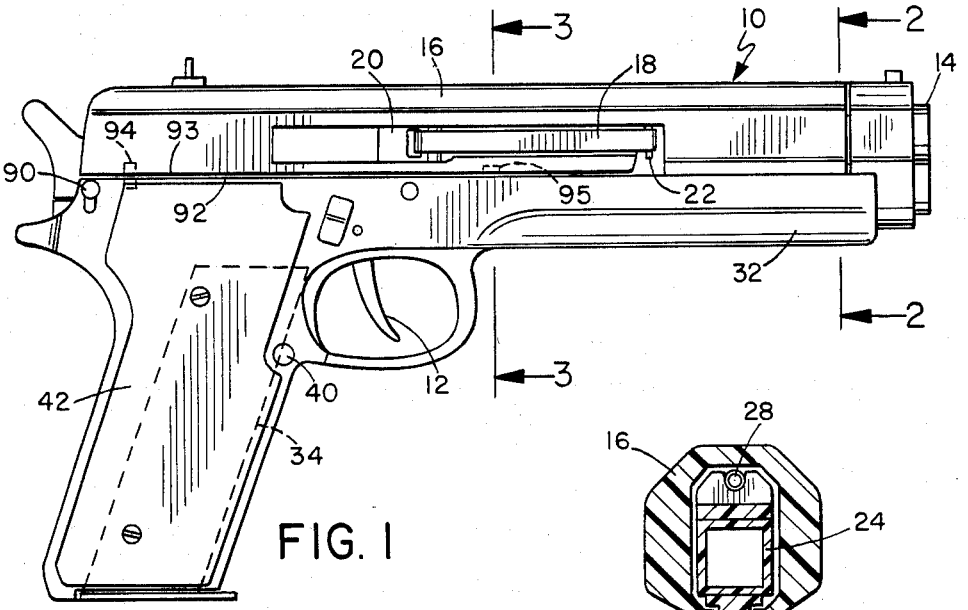
Figure 6:
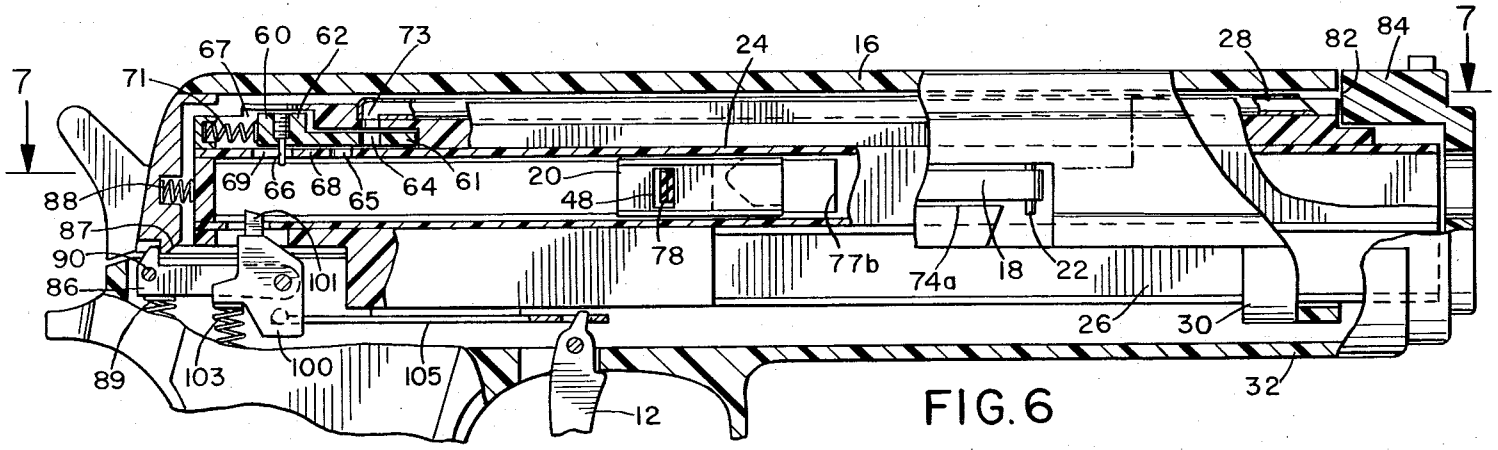
Figure 7:
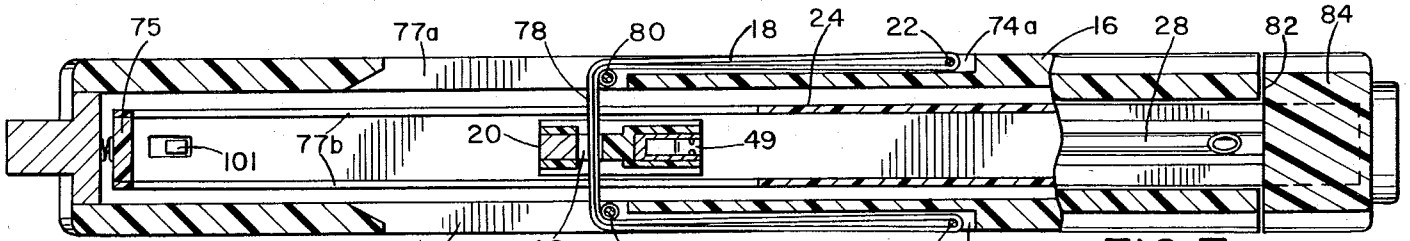
Figure 8:
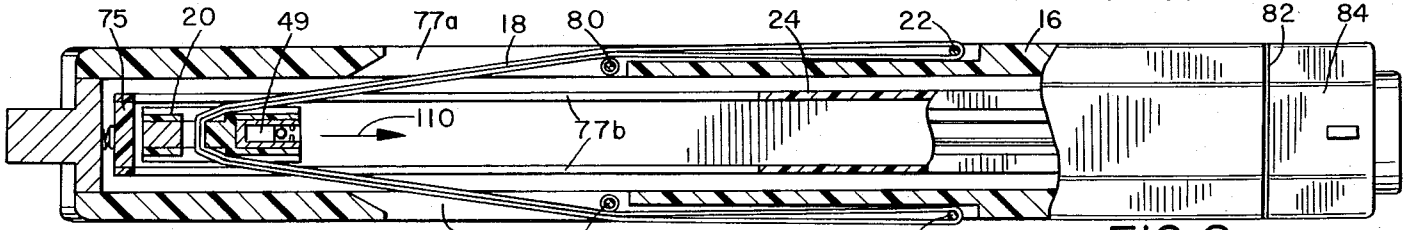
Figure 11:
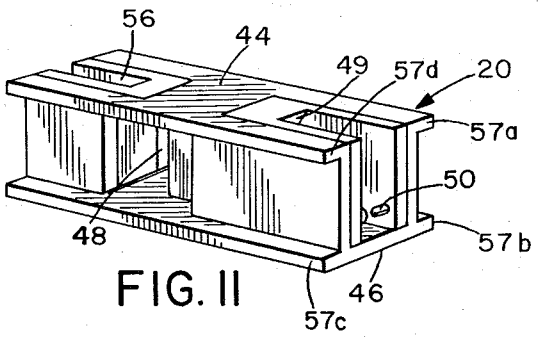
Figure 10:
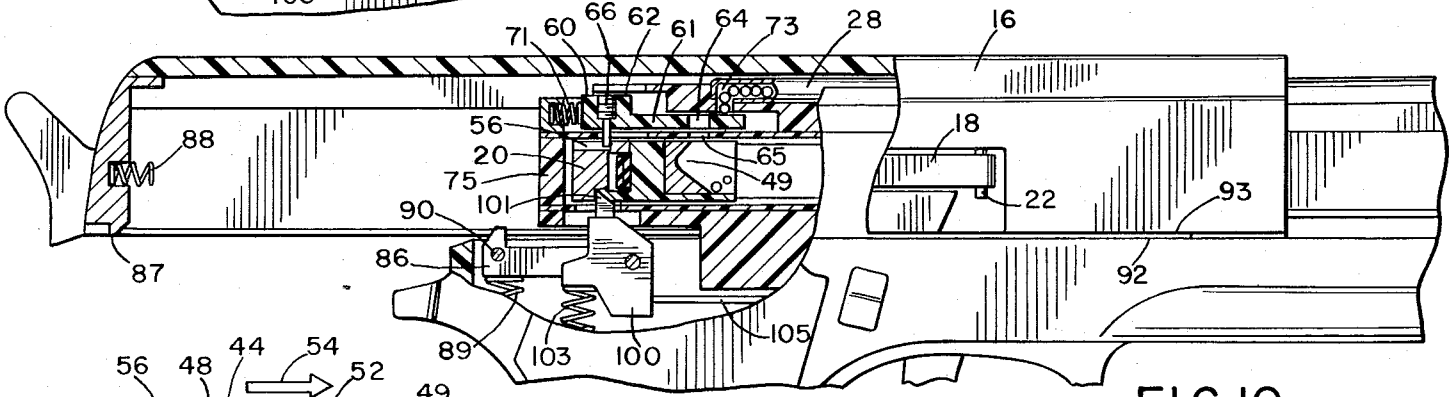
Figure 9:
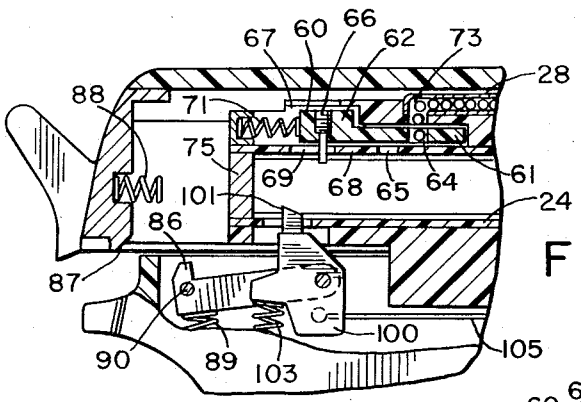
Figure 12:
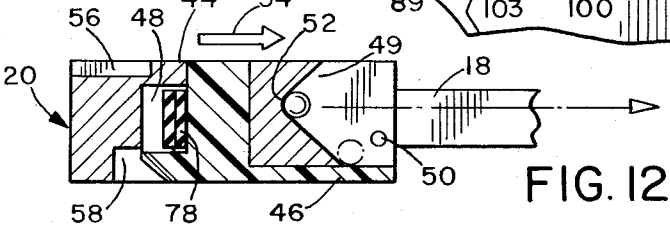

FIG. 6 an enlarged side elevation view, with various portions cut away, showing the rubber band firing mechanism unloaded in a release position;

FIG. 7 is a sectional view taken along line 7—7 of FIG. 6;

FIG. 8 is a view similar to FIG. 7, with a rubber band firing mechanism in a cocked position;

FIG. 9 is similar to a portion of FIG. 6, but with a slide of the pistol released for cocking the firing mechanism;

FIG. 1 is a side elevation view, with portions cut away, showing the cocking and loading action of the firing mechanism;

FIG. 11 is an enlarged perspective view of a projectile-carrying traveller which forms a part of the rubber band powered firing mechanism; and FIG. 12 is an enlarged sectional view of the traveller of FIG. 11, as in FIG. 10, showing the inertial action of a projectile contained in the traveller while the traveller is being accelerated toward the release position.

DETAILED DESCRIPTION OF THE PREFERRED EMBODIMENT

The invention concerns toy guns which fire projectiles without the aid of a charge of gun powder. Throughout the following description, the projectiles which are fired are referred to as "shots"; it is understood that the term "shot" encompasses B-B's, spherical pellets, and other corresponding projectiles. Although these shots are typically spheroid, it is well within the spirit of the invention to adapt the operation and structure of the gun firing mechanism to shots having other geometrical forms.

FIG. 1 shows the gun of the invention as a pistol inside elevation, with the pistol indicated generally by 10. Preferably, the pistol can be made from a combination of injection-molded plastic and stainless steel parts. In the preferred embodiment, the sliding parts of the pistol firing mechanism to be described below are molded plastic parts, while the trigger and slide release mechanisms are largely composed of stainless steel parts.

Figure 2:
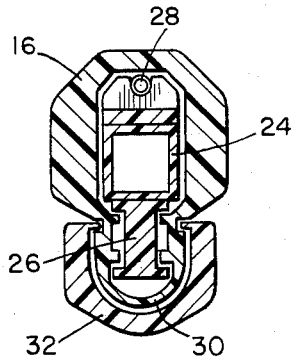
Figure 4:
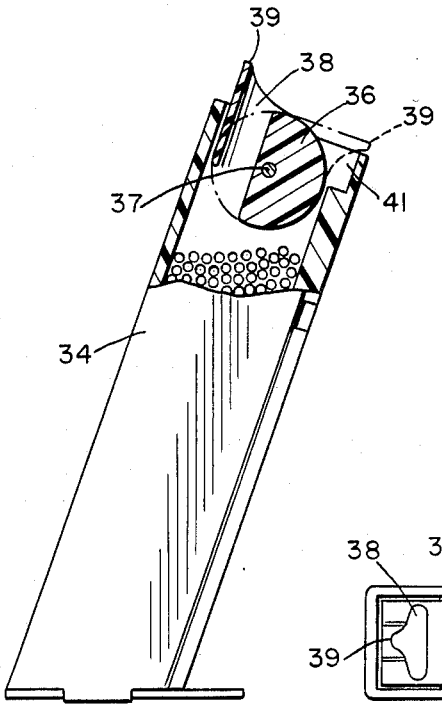
FIG. 4 is a side elevation view, partially cut away, of the shot magazine contained in the grip of the pistol of FIG. 1.
Figure 5:
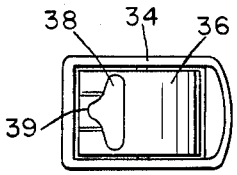
FIG. 5 is a top plan view of the shot magazine of FIG. 4.

The pistol 10 of FIG. 1 includes a trigger 12, a barrel assembly 14, a slide 16, and a firing mechanism including a rubber band 18 and a projectile-carrying traveller 20. As is shown in FIG. 1, the rubber band, visible on one side of the pistol, is looped around a post 22, which is anchored to the slide 16, and is fed through a slot extending through the traveller 20. As shown in FIG. 2, the barrel assembly includes a barrel of square cross section 24 which transitions to a lower barrel track 26. A tubular magazine 28 is attached to the top of and runs the length of the barrel assembly. The magazine has a circular cross section and is of such a diameter as to contain a sequence of spherical shots. The slide 16, in its forward section, transitions to a lower slide loop 30 which is configured to engage the barrel track 26. The lower slide loop 30 permits the slide to be moved in two opposing directions along the barrel assembly, with the slide riding on the barrel track 26.

Figure 3:
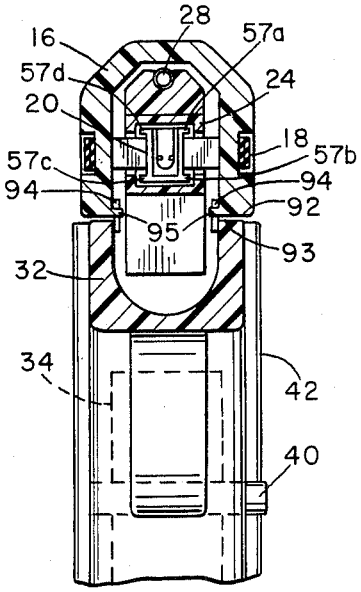

In FIG. 3, the traveller 20 is slidably contained in the rear portion of the barrel 24. As seen, the rubber band 18 extends through the slot in the traveller 20 and is led around the opposing outside edges of the slide 16 within slide grooves 31. The slide 16 engages and rides on the upper surface of a housing 32. The barrel assembly is anchored to the housing 32 and remains stationary therein.

An auxiliary shot magazine is indicated by reference numeral 34 in FIGS. 1, 3, 4, and 5. The auxiliary magazine 34 has a hollow interior within which shots are contained. Access into the auxiliary magazine is obtained through a rotating magazine access mechanism 36 which rotates on a pin 37. The mechanism 36 includes a channel 38 which provides communication into the interior of the magazine 34 when the mechanism 36 is rotated to the position shown in FIGS. 4 and 5. In this position, shots can either be fed into or poured out of the interior of the magazine. When the mechanism 36 is rotated clockwise from the position shown in FIGS. 4 and 5, eventually the lip 39 of the access port 38 engages a recess 41 in the auxiliary magazine, thereby closing the interior of the magazine 34. The magazine 34 is received in a recess in the grip 42 of the pistol 10. The magazine is releasably held in the pistol grip 42 by a finger-operated magazine release mechanism 40.

The shot-carrying traveller is illustrated in FIGS. 11 and 12. Preferably, it has a generally rectangular form with an upper surface 44 and a lower surface 46. A transverse opening 48 is provided, through which the firing rubber band is fed. In the forward portion of the traveller 20 are a projectile seat including a notch 49 and a retainer 50. The notch 49 is generally concave and has a vertex 52. As shown in FIG. 12, a shot is initially held in the projectile seat in a rest position at the bottom of the notch and is retained in the notch by the retainer 50. As the traveller accelerates in the direction of the arrow 54, the inertia of the shot causes it to rise on the inclined surface of the notch toward the upper surface 44 until it reaches the vertex 52 where it is retained while the traveller continues to accelerate. When the traveller 20 is brought up short, the shot lodged in the vertex continues to travel in the direction of the arrow 54. At the rear of the traveller in the upper surface 44 is formed a singulator engagement notch 56. A cocking notch 58 is formed in the traveller lower surface 46. As best shown in FIG. 3, the traveller 20 slides within the square barrel 24. As shown in FIGS. 3 and 11, the sides of the traveller are flanged at 57*a*–57*d*, with the flanges contacting the vertical interior surfaces of the barrel. As FIG. 3 shows, the flanges provide spacing between the vertical interior surfaces of the barrel and the vertical sides of the traveller along which the rubber band 18 extends.

A singulator mechanism is illustrated in FIGS. 6, 9, and 10. The singulator, indicated by reference numeral 60, generally has the shape of an L, lying on its back. The singulator includes a relatively thin forward extension 61 and transitions rearwardly to a relatively wide foot 62. A shot aperture 64 extends through the forward extension, while an engagement pin 66 extends down through and beyond the lower portion of the singulator's foot 62. The singulator 60 is slidably held in an upper chamber 67 formed in the rear of the barrel assembly above the rear of the barrel 24. The singulator 60 rides on the rear portion of the top surface on the upper horizontal wall 68 of the barrel. As shown best in FIG. 6, the rear portion of the upper wall 68 has a slot 69 within which the lower extension of the pin 66 travels. The slot 69 and lower pin extension define the extremes of travel for the singulator 60 in the upper chamber 67. A spring 71, normally under slight compression, holds the singulator 60 in a first position determined by the contact of the lower extension of the pin 66 against the forward end of the notch 69. In this first position, the shot aperture 64 of the singulator is in communication with a vertical magazine aperture 73 formed in the rear of the tubular magazine 28. In a second position, illustrated in FIG. 10, the singulator is moved toward the rear of the barrel 28, compressing the spring 71 and eventually being stopped when the lower extension of the pin 66 contacts the rear end of the slot 69. While moving to the second position, the shot aperture 64 passes over and communicates with a shot hole 65. The compressed spring 71 returns the singulator 60 to the first position illustrated in FIG. 6 from the second position illustrated in FIG. 10.

The reciprocating movement of the slide 16 on the barrel track 26 causes the traveller 20 to move correspondingly within the barrel 24. The movement of the traveller 20 in response to movement of the slide 16 is best understood with reference to FIGS. 7 and 8. As shown in FIG. 7, the rubber band 18 is anchored to the slide 16 by being looped around the pins 22 in the sides of the slide. As shown in FIGS. 6 and 7, a pair of openings 74*a* and 74*b* are cut in the opposing sides of the slide 16. The opposing vertical sides of the slide 16 are cut away at 77*a*. The vertical sides of the barrel 24 are cut away from approximately the midportion of the barrel all the way to the rear 75 of the barrel. The vertical wall cutouts of the barrel are indicated by 77*b* in FIG. 7. As illustrated in FIG. 6, the cutaways in the vertical sides of the slide 18 and the barrel 24 provide an unobstructed transverse passageway for the rubber band through the slide and barrel. This transverse passageway permits the rear portion of the rubber band 18 to be led through the slide and barrel in a direction orthogonal to their axes. This is shown best in FIG. 7 where the rear portion 78 of the rubber band is fed around a pair of stops 80 and through the transverse opening 48 of the traveller 20. With the rubber band 18 thus placed, movement of the slide 16 on the barrel track 26 will be transferred through the rubber band 18 to the traveller 20, causing the traveller to move in synchronism with the slide 16. This arrangement permits the traveller 20 to move, in response to movement of the slide 16, between what will be referred to as a "release" position, illustrated in FIG. 7, and a "cocked" position, illustrated in FIG. 8. As shown in FIG. 10, movement of the slide 16 rearwardly on the barrel track 26 causes the rubber band 18 to move the traveller 20 rearwardly in the barrel 24 until the traveller 20 is stopped by the rear 75 of the barrel. This is the cocked position of the traveller.

As shown in FIGS. 6–8, movement of the slide 16 on the barrel and barrel track 26 is stopped in the forward direction by the edge 82 of the forward portion 84 of the barrel assembly. A spring-operated retainer assembly 86 is illustrated in FIG. 6. As shown in FIG. 6, the retainer 86 contacts the lower rear edge 87 of the slide to retain the slide in its forward position. The slide is also held in this position by the tension in the spring 88 in the rear of the slide, which contacts the rear 75 of the barrel. Tension in the spring 88 retains the edge 87 against the retainer 86. The retainer is released by a downward movement against the spring 89. The downward movement is provided by the thumb-operated lever 90 which protrudes out of the rear of the pistol housing as shown in FIG. 1. Downward movement of the lever 90 causes the retainer assembly 86 to move downwardly out of engagement with the edge 87, thereby permitting the slide to be moved rearwardly on the barrel track 26 as shown in FIG. 10. While the slide is being moved forward to the position illustrated in FIG. 6, the beveled edges of the retainer assembly 86 and the lower slide edge 87 move the retainer downwardly against the spring 89 until the edge 87 clears the retainer, at which time the spring 89 will force the retainer 86 up into contact with the lower edge 87. As shown best in FIGS. 1, 3, 6, and 10, the slide 16 is slidably supported on upper housing edges 92, with the lower slide edges 93 in slidable contact with the housing edges 92. Rearward motion of the slide is arrested when the housing stops 94 are contacted by the slide stops 95 (FIGS. 1 & 3). This is the rearmost position of the slide 16.

With nothing more, the traveller 20 would move reciprocatingly within the rear portion of the barrel 24 in response to rearward and forward motion of the slide 16 between the slide's forward and rearmost positions. However, a trigger releasably retains the traveller 20 at the cocked position when the traveller is moved to the position by rearward movement of the slide 16 to its rearmost position. Retention of the traveller 20 at its cocked position is best understood with reference to FIGS. 10 and 12. When the traveller is moved to its cocked position, it is retained there by the trigger mechanism 100. As shown in FIGS. 6, 9, and 10, the trigger mechanism 100 includes a beveled trigger pin 101, a return spring 103, and a linking shaft 105 connected between the trigger assembly 100 and the trigger 12. As understood by reference to FIGS. 10 and 12, when the traveller 20 moves rearwardly toward the rear 75 of the barrel, its lower surface 46 contacts the beveled edge of the trigger pin 101. The contact against the beveled edge of the pin causes the trigger assembly 100 to rotate downward against the spring 103, compressing the spring 103 and moving the trigger pin 101 down through the pin hole 107 provided at the rear of the bottom horizontal wall of the barrel. The traveller continues its rearward movement until the trigger notch 58 is moved into position over the pin hole 107. At this point, the spring 103 drives the trigger assembly 100 upwardly, inserting the trigger pin 101 in the trigger notch 58. This retains the traveller 20 at its cocked position. The traveller 20 is released from its cocked position when the trigger 12 is pressed rearwardly, which moves the linkage 105 forward and rotates the trigger assembly 100 downwardly, again compressing the spring 103. Rotation of the trigger assembly 100 downwardly moves the trigger pin 101 out of the trigger notch 58, permitting the traveller 20 to move forward in the barrel toward its release position. When the traveller 20 moves forward far enough, the spring 103 returns the trigger pin 101 upwardly through the pin hole 107.

Operation of the pistol will now be described with reference to FIGS. 6–10. In the operational sequence, the slide 16 and traveller 20 are assumed to be as shown in FIG. 6, with the slide at its forward position, the traveller at its release position, and the singulator at its first position. Further, it is assumed initially that a plurality of spherical shots have been fed into the tubular magazine 28; as shown in FIG. 9, the singulator's shot aperture 64 is dimensioned to accept a single spherical shot through the vertical magazine aperture 73. Operation begins with the retainer assembly 86 being rotated downwardly; this permits the slide 16 to be moved rearwardly. Rearward movement of the slide will carry the slide and the traveller from the positions illustrated in FIG. 7 toward the rear 75 of the barrel 24. As the traveller 20 moves toward the rear 75, it will catch the lower tip of the singulator's pin 66 in the singulator engagement notch 56. By virtue of engagement of the lower end of the pin 66 by the notch 56, further rearward movement of the traveller 20 will move the singulator 60 rearwardly against its spring 71. As shown in FIG. 10, movement of the traveller 20 to its cocked position will carry the singulator rearward. As it moves rearwardly from the position of FIG. 9, the singulator will carry the single shot in its aperture 64 until the shot drops through the aperture 65 (FIG. 10) into the projectile seating notch 49 of the traveller 20. The shot will be retained in the notch by the retainer 50. This is illustrated in FIG. 10. The traveller 20 is now at its cocked position, where it will be retained, loaded with a single shot, by the beveled trigger pin 101. Now, the slide 16 is moved forwardly from the position of FIG. 10 toward its forward position. As the slide 16 moves toward its position of FIG. 6, the traveller 20 is retained at its cocked position by the trigger mechanism. This causes the rubber band 18 to stretch since it is connected between the slide 16 and the now stationary traveller 20. As the slide 16 is moved to its forwardmost position, the lower slide edge 87 will engage the retainer assembly, retaining the slide in its forward position. This will place the rubber band 18 in the stretched configuration illustrated in FIG. 8. As shown in FIG. 8, with the traveller 20 in its cocked position and the slide 16 retained in its forward position, the rubber band 18 exerts an elastic force in the direction of the arrow 110. Now, when the trigger 12 is pressed rearwardly, the trigger assembly 100 will release the traveller 20 from its cocked position, permitting the stretched rubber band 18 to accelerate the traveller 20 forwardly toward its release position. The traveller 20 accelerates in response to the stretched rubber band until the rubber band is stopped by the stops 80 in the side of the slide 16. As the traveller 20 accelerates from its cocked toward its release position, the inertia of the spherical shot causes it to raise into the vertex 52 as illustrated in FIG. 12. The spherical shot remains here for so long as the traveller accelerates toward its release position. As shown in FIG. 7, when the traveller 20 reaches its release position, the stops 80 prevent the rubber band 18 from contracting any further and abruptly halt the forward motion of the traveller 20 in the barrel 24. At the release point, momentum of the unrestrained spherical shot causes it to continue travelling out of the traveller 20 forwardly toward the muzzle of the barrel 24. As the spherical shot continues on this trajectory, it exits the barrel at the barrel's muzzle. When the traveller 20 is released from its cocked position and moves forward toward its release position, the spring 71 causes the singulator 60 to travel forwardly with the traveller until stopped by the contact of the tip of the pin 66 in the forward end of the notch 69. This carries the singulator back to its first position, illustrated in FIGS. 6 and 9, and loads another single shot in preparation for another firing sequence identical to that just described.

Obviously, many modifications and variations of the described invention are possible in light of these teachings; for example, the toy gun might be a rifle instead of a pistol. Therefore, it is understood that the invention may be practiced otherwise than as specifically described.

I claim:

1. A rubber and band powered toy gun, comprising:

a barrel assembly including a magazine for holding shots;

a shot singulator slidably held in said barrel assembly, said shot singulator movable in said barrel assembly between a first position in communication with said magazine and a second position out of communication with said magazine;

aperture means in said shot singulator for accepting a single shot from said magazine at said first position;

a traveler mechanism slidably held in said barrel assembly, said traveler mechanism movable in s aid barrel assembly between a release position and a cocked position;

means in said traveler mechanism for engaging said shot singulator and moving said shot singulator from said first to said second position when said traveler mechanism moves from said release to said cocked position;

means in said traveler mechanism for receiving a shot from said singulator at said second position and for retaining a received shot while said traveler mechanism moves from said cocked position to said release position;

a cocking slide slidable on said barrel assembly for moving said traveler mechanism from said release to said cocked position; and an elongate elastic member attached to said traveler mechanism and to said cocking slide for accelerating said traveler mechanism from said cocked position to said release position.

2. The rubber band powered pistol of claim 1 further including trigger means for retaining said traveller mechanism in said cocked position and for being operated to release said traveller mechanism from said cocked position.

3. The rubber band powered pistol of claim 2 further including means for returning said shot singulator from said second to said first position in response to said traveller mechanism means moving from said cocked to said release position.

4. The rubber band powered pistol of claim 1 wherein said elongate elastic member is in the form of a closed loop in a stretched elongated configuration with two ends attached to said slide and a middle engaged by said slinging mechanism.

5. A rubber band pistol, comprising:

a barrel assembly with a shot magazine;

a shot traveller means slidably held in said barrel assembly for receiving a shot, for moving a shot to a cocked position in said barrel assembly and for propelling a shot into a firing trajectory extending through said barrel assembly by accelerating from said cocked position to a release position;

singulating means in said barrel assembly for feeding a single shot from said magazine to said shot traveller means when said shot traveller means moves from said release to said cocked position;

a slide movable on said barrel assembly for engaging and moving said shot traveller means to said cocked position and for disengaging said shot traveller means at said cocked position and moving toward said release position;

elastic means connected between said shot traveller means and said slide for exerting an elastic force toward said release position on said shot traveller means at said cocked position in response to movement of said slide toward said release position; and trigger means for retaining said traveller means at and releasing said shot traveller means from said cocked position.

6. The rubber band pistol of claim 5 wherein said shot traveller means includes a traveller mechanism, a shot notched formed in a forward portion of said traveller mechanism, a singulating means engagement notch formed in an upper rear portion of said traveller mechanism, and a trigger means engagement notch formed in a lower rearward portion of said traveller mechanism.

7. The rubber band gun of claim 6 wherein said shot notch has a substantially concave shape with upper and lower ramp surfaces which meet at a vertex, and means for retaining a shot against said lower ramp surface.

8. The rubber band gun of claim 5 wherein said singulating means includes an L-shaped singulator slidably disposed in said barrel assembly adjacent said magazine, said singulator having a relatively narrow forward portion and a relatively wide foot portion, a shot retaining aperture in said forward portion which receives a single shot from said magazine, and an engagement pin in said foot portion for engaging said singulating means engagement notch.

9. The rubber band sun of claim 8 wherein said singulator is disposed in s aid barrel assembly above said traveller mechanism and is engaged by said traveller mechanism and moved away from said magazine to a position at which said shot-retaining aperture is in communication with said shot notch.

10. In a toy gun having a barrel assembly with a shot magazine, a housing, and a trigger mechanism in said housing and operable at a cocked position in said gun, the improvement comprising:

a rubber band powered firing mechanism including:

shot traveller means responsive to said trigger mechanism and slidably held in said barrel for moving to and being retained by said trigger mechanism at said cocked position and for being released and accelerated in said barrel from said cocked position to a release position;

singulating means slidable in said barrel for receiving a single shot from said magazine at a first position adjacent said magazine and for being moved to a second position at which said singulating means feeds a received shot to said shot traveller means;

means for moving said singulating means from said first to said second position in response to said shot traveller moving to said cocked position;

slide means for moving said shot traveller means from said release position to said cocked position; and stretchable elastic means operable between said shot traveller means and said slide means for exerting an elastic force on said shot traveller means retained at said cocked position and for accelerating said shot traveller means from said cocked position to said release position in response to said shot traveller being released from said cocked position.

11. The rubber band powered firing mechanism of claim 10 including spring means for retaining said singulating means from said second to said first position in response to said shot traveller means accelerating from said cocked position to said release position.

* * * * *